US011035384B2

(12) United States Patent
Fazio et al.

(10) Patent No.: US 11,035,384 B2
(45) Date of Patent: Jun. 15, 2021

(54) SILENCER FOR AN AIR BLOWER ASSEMBLY AND AIR BLOWER ASSEMBLY HAVING THE SILENCER

(71) Applicant: SONNY'S ENTERPRISES, LLC, Tamarac, FL (US)

(72) Inventors: Paul Fazio, Plantation, FL (US); Anthony Analetto, Weston, FL (US)

(73) Assignee: Sonny's Enterprises, LLC, Tamarac, FL (US)

( * ) Notice: Subject to any disclaimer, the term of this patent is extended or adjusted under 35 U.S.C. 154(b) by 6 days.

(21) Appl. No.: 16/354,587

(22) Filed: Mar. 15, 2019

(65) Prior Publication Data

US 2019/0331136 A1 Oct. 31, 2019

Related U.S. Application Data

(60) Provisional application No. 62/662,291, filed on Apr. 25, 2018.

(51) Int. Cl.
*F04D 29/66* (2006.01)
*F04D 29/42* (2006.01)

(52) U.S. Cl.
CPC ..... *F04D 29/664* (2013.01); *F04D 29/4213* (2013.01); *F04D 29/4226* (2013.01); *F05D 2260/96* (2013.01)

(58) Field of Classification Search
CPC ..... F04D 29/664; F04D 29/4226; F04D 29/4213; F05D 2260/96
See application file for complete search history.

(56) References Cited

U.S. PATENT DOCUMENTS 2,942,683 A * 6/1960 Moyer ..... F04D 29/664 181/229
3,120,876 A * 2/1964 Lirette ..... F04D 29/664 181/229
3,903,562 A * 9/1975 Miles ..... B60S 3/002 15/301
4,204,586 A * 5/1980 Hani ..... F04D 29/664 181/229
4,258,821 A * 3/1981 Wendt ..... F04D 29/664 181/202
4,759,422 A * 7/1988 Belley ..... A47L 9/22 15/326

(Continued)

FOREIGN PATENT DOCUMENTS

GB 1529946 A * 10/1978 ..... F02M 35/1288
GB 2263502 A * 7/1993 ..... F04D 29/664

*Primary Examiner* — Eldon T Brockman
(74) *Attorney, Agent, or Firm* — Laurence A. Greenberg; Werner H. Stemer; Ralph E. Locher

(57) ABSTRACT

An air blower assembly has a main housing with an air inlet opening and an air inlet housing is disposed around the air inlet opening and connected to the main housing. The air inlet housing defines an air inlet channel leading into the air inlet opening in the main housing. An air outlet channel is connected to the main housing, the air outlet is fluidically connected to the air inlet channel. A fan is disposed in the main housing for driving airflow through the air inlet channel to the air outlet. A silencer covers the air inlet housing and redirects air into the air inlet channel. The silencer controls the direction of air flow into the air inflow channel and noises generated by the fan assembly and the air flow stream are absorbed by a noise cancelling material and walls of the silencer.

19 Claims, 4 Drawing Sheets

(56) References Cited

U.S. PATENT DOCUMENTS 4,808,090 A * 2/1989 Evans ..... F04D 17/164 415/119
5,189,754 A * 3/1993 Sauter ..... B60S 3/002 15/316.1
5,560,078 A * 10/1996 Toensing ..... A47L 9/02 15/339
5,922,095 A * 7/1999 Hustvedt ..... B01D 45/06 454/187
5,979,595 A * 11/1999 Harris ..... F04D 29/4213 181/214
6,112,850 A * 9/2000 Secrest ..... F04D 29/663 181/224
6,148,954 A * 11/2000 Harris ..... F04D 29/4213 181/224
6,155,801 A * 12/2000 Elnar ..... A61H 33/028 417/363
6,193,011 B1 * 2/2001 Harris ..... F04D 29/4213 181/214
6,375,719 B1 * 4/2002 Hustvedt ..... B01D 45/06 454/187
6,736,238 B2 * 5/2004 Kerr ..... F04D 29/663 181/229
7,490,697 B1 * 2/2009 Williamson, Jr. ..... B60P 3/36 181/200
8,307,948 B2 * 11/2012 Parodi ..... A45D 20/12 181/258
2011/0203128 A1 * 8/2011 Rodrigues ..... A45D 20/12 34/96
2012/0024620 A1 * 2/2012 Parodi ..... A45D 20/12 181/212
2014/0299005 A1 * 10/2014 Vinett ..... A23B 4/052 99/482
2015/0343965 A1 * 12/2015 Rowland ..... B60R 13/02 454/165

* cited by examiner

SILENCER FOR AN AIR BLOWER ASSEMBLY AND AIR BLOWER ASSEMBLY HAVING THE SILENCER

CROSS-REFERENCE TO RELATED APPLICATION

This application claims the priority, under 35 U.S.C. § 119, of U.S. provisional patent application No. 62/662,291, filed Apr. 25, 2018; the prior application is herewith incorporated by reference in its entirety.

BACKGROUND OF THE INVENTION

Field of the Invention

The invention relates in general to silencers that are part of or retrofitted to blower assemblies.

Automated carwash installations are generally equipped with air blowing dryers for drying passing vehicles. Unfortunately, the air blowing dryers are extremely noisy and their high sound output levels create problems with customers, local residents, as well as employees who may suffer ear damage if they do not wear ear protection. In general, conventional dryers have blowers that are powered by electric motors of high horsepower providing the force necessary to propel air along the path of travel. A large percentage of the blowers used for carwash dryers are powered by motors of varying but high horsepower (HP). Each blower is a fan assembly, with its own electric motor, impeller and housing. A drying system typically is composed of multiple blowers, the total HP for a drying system can add up to more than 100 HP.

Unfortunately such large horsepower motors produce a large amount of noise. There is therefore the need to silence existing motors and new fan assemblies as best as possible and thus to reduce noise pollution.

SUMMARY OF THE INVENTION

It is accordingly an object of the invention to provide a silencer that can be retrofitted to an existing blower assembly used in an automated carwash that overcomes the above-mentioned disadvantages of the prior art devices of this general type. In addition, new blower assemblies can be provided with a built-in silencer.

With the foregoing and other objects in view there is provided, in accordance with the invention, a blower assembly. The blower assembly has a main housing with an air inlet opening and an air inlet housing disposed around the air inlet opening and connected to the main housing. The air inlet housing defines an air inlet channel leading into the air inlet opening in the main housing. An air outlet channel is connected to the main housing and defines an air outlet from the main housing, the air outlet is fluidically connected to the air inlet channel. A fan is disposed in the main housing for driving an airflow through the air inlet channel to the air outlet. A silencer covers the air inlet housing and directs air into the air inlet channel.

In accordance with an added feature of the invention, the silencer has a plurality of airflow openings for directing the air into the air inlet channel. Furthermore, the silencer has slidable coverings for individually opening and closing the airflow openings for controlling an amount of the airflow into the air inlet channel.

In accordance with another feature of the invention, the silencer has a silencer housing surrounding the air inlet housing. The silencer housing is connected to the air inlet housing and/or the main housing.

In accordance with a further feature of the invention, the silencer housing includes a cylindrical lower housing part and a cylindrical upper housing part. The cylindrical upper housing part has a first diameter being greater than a second diameter of the cylindrical lower housing part. The silencer housing further has an end cover attached to one end of the cylindrical upper housing part.

In accordance with an additional feature of the invention, a sound deadening material is disposed on an inner wall of the end cover. The sound deadening material is ideally further disposed on the inner cylindrical walls of the cylindrical upper housing part. Ideally, the sound deadening material is a foam material having an egg crate shape although many other shapes and materials are possible.

In accordance with yet another feature of the invention, the cylindrical upper housing part has a first end supporting the end cover and a second end with a protrusion extending toward an interior of the silencer housing. The protrusion supports an outer surface of the cylindrical lower housing part. In this manner, the cylindrical lower housing part is nestled within the cylindrical upper housing part. Although the upper and lower housing parts are ideally cylindrical in shape, other shapes such as square shaped, rectangular shaped or U-shaped are possible.

In accordance with another further feature of the invention, the air flow openings are only formed in the cylindrical upper housing part.

In accordance with a concomitant feature of the invention, the cylindrical lower housing part has an outer rim with at least two recesses for receiving fasteners for attaching the silencer housing to the air inlet housing and/or the main housing.

With the foregoing and other objects in view there is provided, in accordance with the invention, a silencer for attaching to a blower assembly. The silencer contains a silencer housing having a lower housing part and an upper housing part with a plurality of airflow openings for providing an airflow stream into an interior of the silencer housing. A noise cancelling material is disposed at least in the upper housing part.

In accordance with an added feature of the invention, the upper housing part has a circumference and six airflow openings are disposed around the circumference.

Other features which are considered as characteristic for the invention are set forth in the appended claims.

Although the invention is illustrated and described herein as embodied in a silencer for an air blower and an air blower having the silencer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
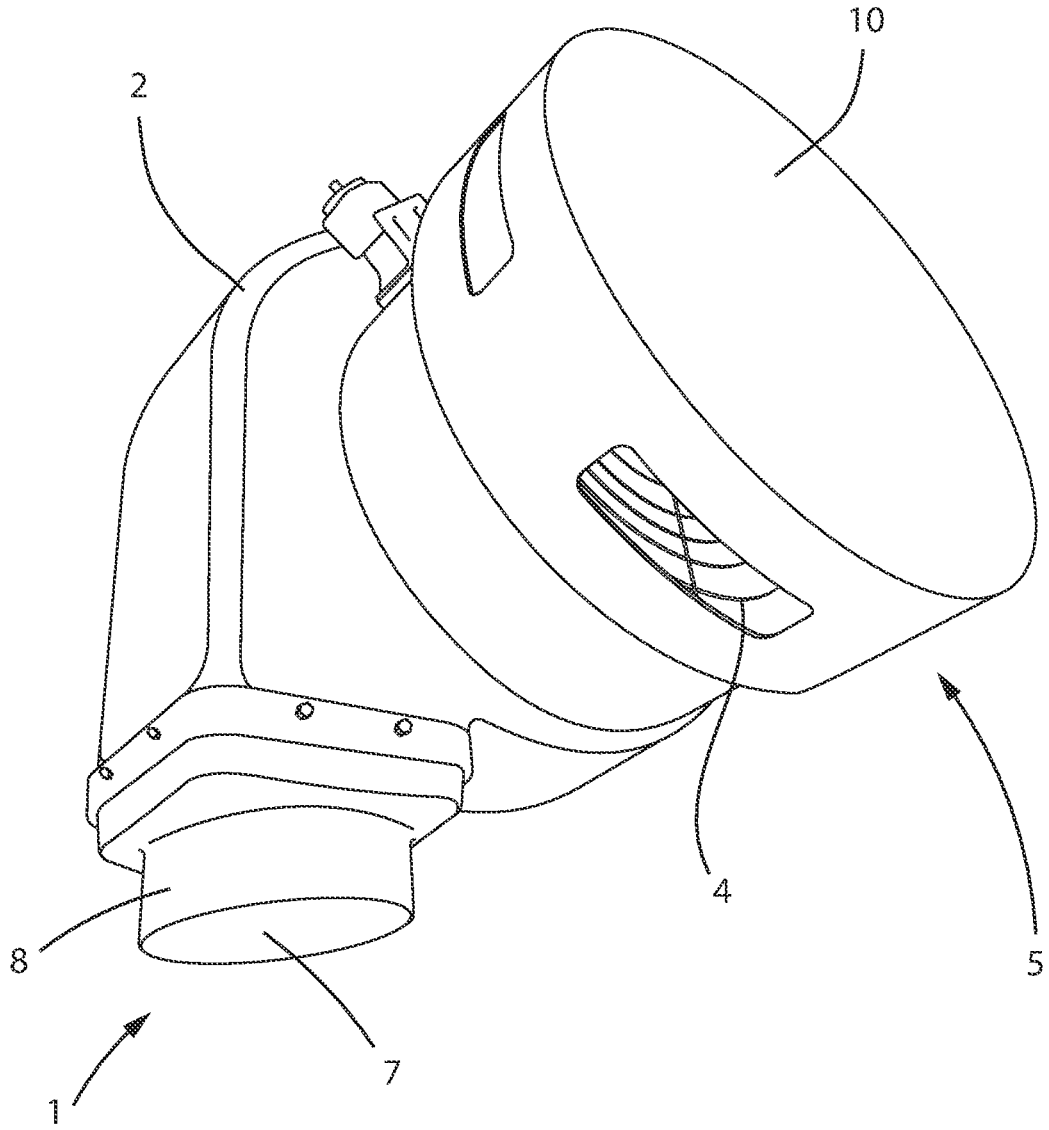
FIG. 1 is a perspective view of a blower assembly having a silencer attached thereto according to the invention.
Figure 2:
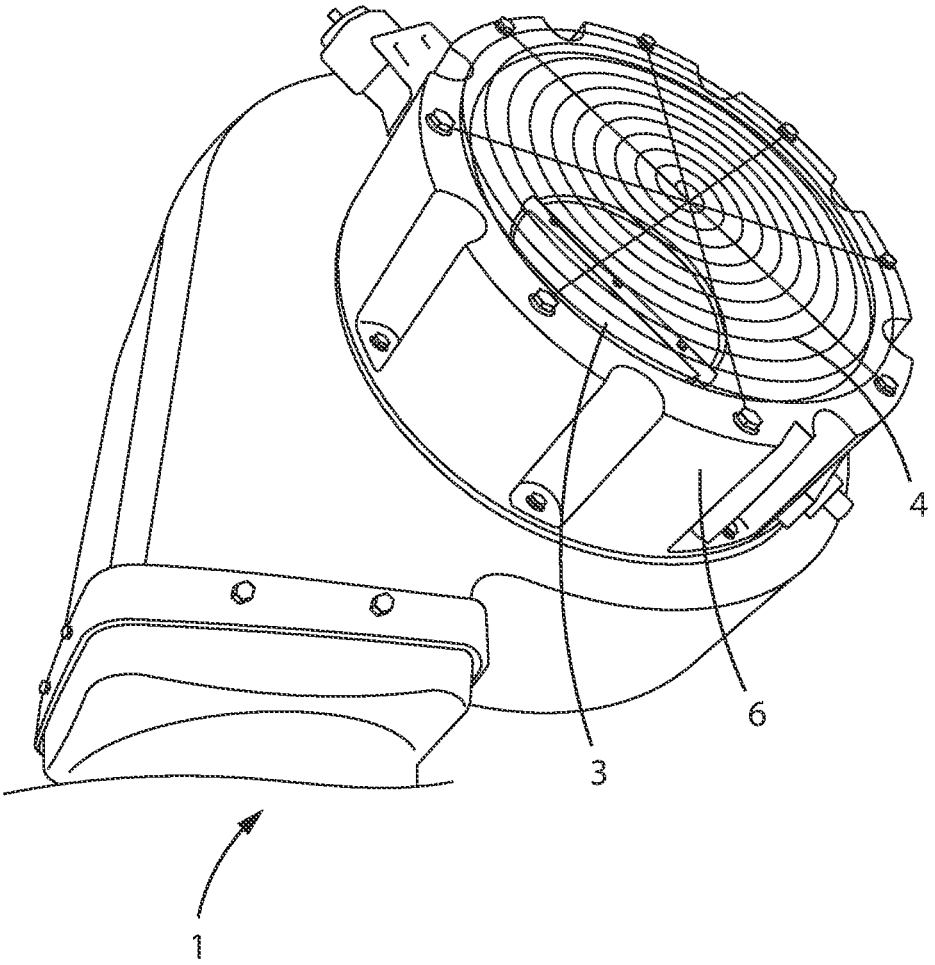
FIG. 2 is a perspective view of the blower assembly without the silencer.

Referring now to the figures of the drawings in detail and first, particularly to FIGS. 1 and 2 thereof, there is shown a blower assembly 1 having a main housing 2 containing a fan assembly 3 (see FIG. 2), an air inlet 4 and an air or blower outlet 7 defined by an outlet channel 8. The blower assembly 1 has a silencer 5 covering or limiting the air inlet 4.

FIG. 2 shows the blower assembly 1 with the silencer 5 removed. After the silencer 5, the air inlet 4 or air inlet path is defined by an inlet housing 6 disposed in front of the fan assembly 3. The fan assembly 3 is driven by a non-illustrated fan motor disposed on an opposite side of the main housing 2. The fan assembly 3 sucks in a high quantity of air via the air inlet 4. However, and as noted above, the non-illustrated motor, the rotating fan assembly 3 and the incoming air flow traversing the air inlet 4 create an abundance of noise which is abated to a large degree by the silencer 5.

Figure 3:
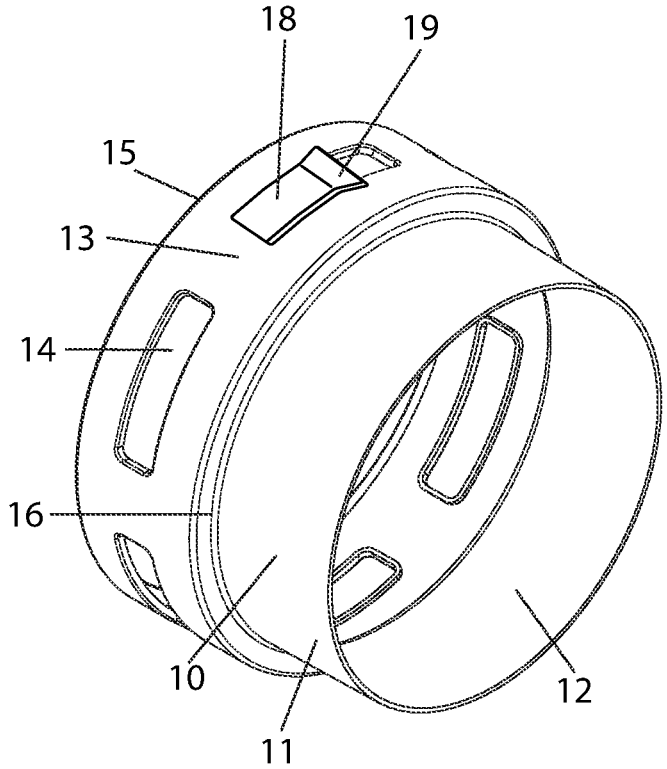
FIG. 3 is a diagrammatic, perspective view of the silencer.
Figure 4:
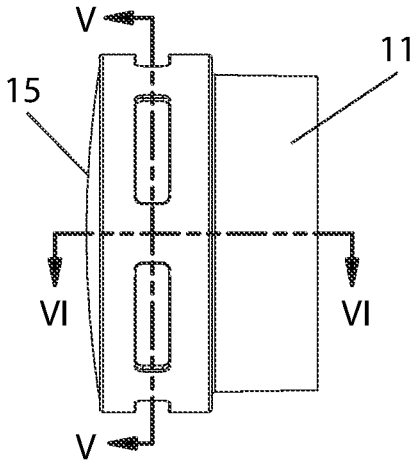
FIG. 4 is a side view of the silencer.
Figure 5:
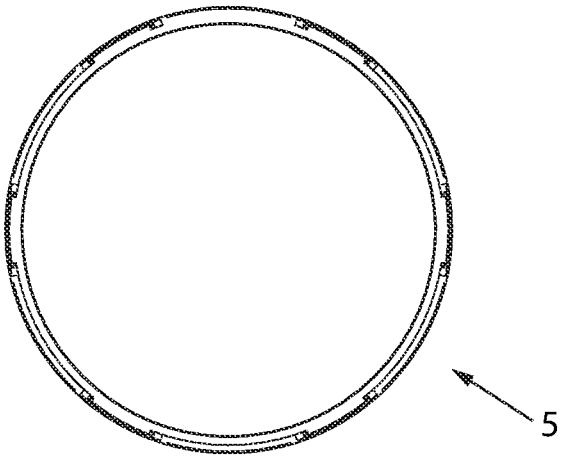
FIG. 5 a sectional view of the silencer taken along the line V-V shown in FIG. 4.
Figure 6:
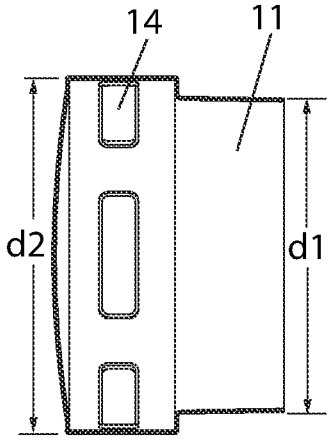
FIG. 6 is a sectional view of the silencer taken along the line VI-VI shown in FIG. 4.

FIGS. 3-7 show various views of the silencer 5. As shown in FIGS. 1 and 3, the silencer 5 has a noise canceling silencer housing 10 that is attached over the air inlet 4 of the blower assembly 1. More specifically, the silencer housing 10 has a lower housing part 11 that has a main frontal opening 12 that is configured to slide over the air inlet 4 and is attached using zip screws from the side to the inlet housing 6 and/or the main housing 2. The lower housing part 11 has a cylindrical or circular shape which is preferable due to its symmetry but could conceivably be rectangular, square or even U-shaped.

The silencer housing 10 has an upper housing part 13 with a plurality of airflow openings 14 and a cap 15 covering an end side of the upper housing part 13. The upper housing part 13 is also cylindrical or circular shaped. Air coming into the blower assembly 1 is re-directed to come in from the six airflow openings 14. The airflow openings 14 are ideally spaced equally apart and symmetrically around a circumference of the upper housing part 13. Although FIG. 3 shows six openings 14, any number of openings can be provided in dependence on airflow needs and tolerable noise levels, for example anywhere from 2 to 10 airflow openings 14 are envisioned. In addition, the individual airflow openings 14 can have a closing cover 18 so that the airflow opening 14 can be individually opened fully, opened partially or closed for increasing or decreasing the airflow and the noise level. The closing covers 18 having tabs 19 and are manually slidably for allowing a partial to full closing of the airflow openings 14. The airflow openings 14 are shown to be rectangular in shape but may have different shapes such as circular, square, trapezoid, etc.

By having the air inlet 4 mostly covered over 360 degrees by the silencer 5 it keeps the noise caused by the fan assembly 3 and air flow contained within the silencer 5 and housings 2, 6 and reduces the number of surfaces that the noise can bounce off of while maintaining an adequate air flow.

The upper housing part 13 is also cylindrical shaped and has a diameter d2 which is greater than a diameter d1 of the lower housing part 11. The two housing parts 11, 13 are connected at an inner step or protrusion 16 of the upper housing part 13. The upper housing part 13 supports the lower housing part 11 at or by the step or protrusion 16.

Figure 7:
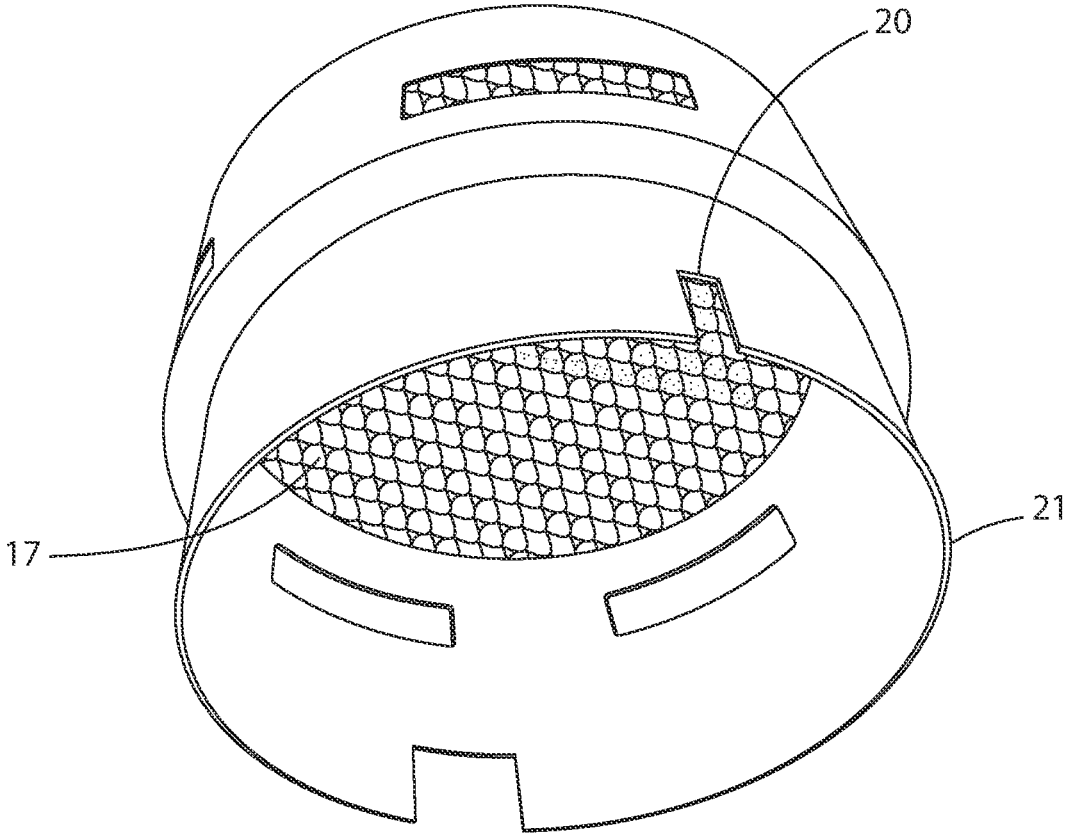
FIG. 7 is a further diagrammatic, perspective view of the silencer showing an insulating material.

As best shown in FIG. 7, the noise cancelling housing 10 is lined with a noise cancelling material 17 such as but not limited to foam. The foam 17 ideally has an egg crate configuration or shape with an adhesive backing. The noise cancelling material 17 can be added to one or multiple walls of the noise cancelling housing 10 and is attached there preferably by an adhesive connection (e.g. glued) but other connections methods are possible (e.g. riveted, screwed, etc). FIG. 7 further shows slots 20 formed at an outer rim 21 in which non-illustrated fasteners (e.g. bolts) can penetrate through for attaching the silencer 5 to the inlet housing 6 of the blower assembly 1.

The silencer housing 10 can be made from a metal, plastic or composite material.

As can be easily deduced from the drawings the silencer 5 can be an integrated feature in newly produced blower assemblies 1 or it can be retrofitted onto an existing blower assembly 1.

In operation, air coming into the blower assembly 1 is re-directed and limited by the airflow openings 14. The number and size of the openings 14 can be customized to a consumer's operational needs. The silencer 5 controls the direction of air flow into the air inflow channel 4 and also provides acoustic soundproofing. More specifically, the airflow openings 14 are perpendicular the main air inflow channel 4. Thus noises coming from the fan assembly 3 and the air flow stream are absorbed by the noise cancelling material 17 and the walls of the silencer 5. It is noted that the 90 degrees turn by the airflow entering from the outside into airflow channel 4 assists in abating noise. More specifically, exiting noise will first strike the noise cancelling material 17 and the walls of the silencer 5.

The design intent is to create a silencer 5 or silencer kit 5 for retrofit applications, which is bolted onto the inlet airflow side of the blower fan assembly 1 in order to reduce noise levels caused by the blower assembly's operation. The silencer 5 is principle ideally used in blower assemblies 1 intended to dry vehicles in carwash applications, namely blower dryers.

By directing air from limited directions, noise is directed in a direction of flow coming into the inlet which decreases the sound waves going into adjacent walls. The sound absorbing material 17 on the inside of the housing 10 further reduces the sound waves emitted as the air is forced inside the blower assembly 1.

As can be easily deduced from the drawings the silencer 5 can be an integrated feature in newly produced blower assemblies 1 or it can be retrofitted onto an existing blower assembly 1.

The invention claimed is:

1. A blower assembly, comprising:

a main housing having an air inlet opening formed therein;

an air inlet housing, being separate from said main housing, disposed around said air inlet opening and connected to said main housing, said air inlet housing defining an air inlet channel leading into said air inlet opening in said main housing;

an air outlet channel connected to said main housing and defining an air outlet from said main housing, said air outlet fluidically connected to said air inlet channel;

a fan disposed in said main housing for driving an airflow through said air inlet channel to said air outlet; and a silencer covering said air inlet housing and directing air into said air inlet channel, said silencer having a silencer housing surrounding said air inlet housing, said silencer housing having a lower housing part and an upper housing part, said upper housing part spaced from said main housing and said upper housing part having a plurality of airflow openings formed therein for directing the air into said air inlet channel.

2. The blower assembly according to claim 1, wherein the airflow enters said upper housing part and flows past said air inlet channel and then into said air inlet opening.

3. The blower assembly according to claim 1, wherein said silencer has slidable coverings for individually opening and closing said airflow openings for controlling an amount of the airflow into said air inlet channel.

4. The blower assembly according to claim 1, wherein said silencer housing being connected to at least one of said air inlet housing or said main housing.

5. The blower assembly according to claim 4, wherein said said lower housing part is a cylindrical lower housing part and said upper housing part is a cylindrical upper housing part.

6. The blower assembly according to claim 5, wherein said cylindrical upper housing part has a first diameter being greater than a second diameter of said cylindrical lower housing part.

7. The blower assembly according to claim 6, wherein said silencer housing further has an end cover attached to one end of said cylindrical upper housing part.

8. The blower assembly according to claim 7, further comprising a sound deadening material disposed on an inner wall of said end cover.

9. The blower assembly according to claim 8, wherein said sound deadening material is further disposed on inner cylindrical walls of said cylindrical upper housing part.

10. The blower assembly according to claim 7, wherein said cylindrical upper housing part has a first end supporting said end cover and a second end with a protrusion extending toward an interior of said silencer housing, said protrusion supports an outer surface of said cylindrical lower housing part.

11. The blower assembly according to claim 8, wherein said sound deadening material is a foam material having an egg crate shape.

12. The blower assembly according to claim 5, wherein said cylindrical lower housing part has a first diameter and said cylindrical upper housing part having said airflow openings has a second diameter being greater than the first diameter.

13. The blower assembly according to claim 5, wherein said cylindrical lower housing part has an outer rim with at least two recesses formed therein for receiving fasteners for attaching said silencer housing to at least one of said air inlet housing or said main housing.

14. A silencer for attaching to a blower assembly, the silencer comprising:

a silencer housing having a lower housing part and an upper housing part, said upper housing part having a plurality of airflow openings formed therein for providing an airflow stream into an interior of said silencer housing, said lower housing part disposed below said upper housing part in a longitudinal direction of said silencer housing, said silencer housing having an end cover integrated on one end face of said upper housing part and completely closing off said one end face of said upper housing part; and a noise cancelling material disposed at least in said upper housing part.

15. The silencer according to claim 14, wherein said upper housing part has a circumference and six said airflow openings are disposed around said circumference.

16. The silencer according to claim 15, further comprising slidable coverings for individually opening and closing said airflow openings for controlling an amount of airflow into said interior of said silencer housing.

17. The silencer assembly according to claim 15, wherein:

said lower housing part is a cylindrical lower housing part having a first diameter; and said upper housing part is a cylindrical upper housing part having a second diameter being greater than said first diameter of said cylindrical lower housing part.

18. The silencer according to claim 17, wherein said noise canceling material is disposed on an inner cylindrical wall of said cylindrical upper housing part.

19. The silencer according to claim 14, wherein said noise canceling material is a foam material having an egg crate shape.

* * * * *